US007617817B1

(12) United States Patent
Kulp

(10) Patent No.: US 7,617,817 B1
(45) Date of Patent: Nov. 17, 2009

(54) LOW PROFILE PAINTBALL LOADER MOUNT

(76) Inventor: Donald Lee Kulp, 2 Karen Ct., Lititz, PA (US) 17543

( * ) Notice: Subject to any disclaimer, the term of this patent is extended or adjusted under 35 U.S.C. 154(b) by 416 days.

(21) Appl. No.: 11/311,524

(22) Filed: Dec. 19, 2005

(51) Int. Cl.
*F41B 11/02* (2006.01)

(52) U.S. Cl. ..... 124/45; 124/51.1; 124/73

(58) Field of Classification Search ..... 124/49, 124/51.1, 73, 74, 45; 248/74.1, 74.2, 74.3, 248/74.4
See application file for complete search history.

(56) References Cited

U.S. PATENT DOCUMENTS

| | | | | |
|---|---|---|---|---|
| 991,192 | A * | 5/1911 | Battenfeld | 248/74.3 |
| 2,215,283 | A * | 9/1940 | Adler | 174/40 CC |
| 2,396,062 | A * | 3/1946 | Tinnerman | 174/40 CC |
| 5,221,064 | A * | 6/1993 | Hodges | 248/59 |
| 5,794,606 | A | 8/1998 | Deak | |
| 5,954,042 | A | 9/1999 | Harvey | |
| 6,109,252 | A | 8/2000 | Stevens | |
| 6,327,953 | B1 | 12/2001 | Andresen | |
| 6,488,019 | B2 | 12/2002 | Kotsiopoulos | |
| 6,502,567 | B1 | 1/2003 | Christopher et al. | |

* cited by examiner

*Primary Examiner*—John Ricci
(74) *Attorney, Agent, or Firm*—Andrew D. Mead

(57) ABSTRACT

The invention is an improvement to an active paintball loader used to feed a supply of paintballs to the breech of a paintball marker wherein the loader is located remote from the marker breech to reduce the target profile of the paintball game player. The loader includes a conventional reservoir for storing a quantity of paintballs, a drive mechanism for moving individual paintballs out of the loader reservoir and into a feed tube where they are forced to the breech inlet of the marker. Locating the loader on the compressed gas storage cylinder reduces the frontal area of the marker/loader combination thereby reducing the target area of a competitor using the LRL during a paintball competition. The location also improves the balance of the combination marker, loader, gas cylinder apparatus making it easier for the player to handle during evasive maneuvers during paintball game play. The improved location of the loader relative to the breech inlet also allows use of a substantially straight feed tube which reduces the propensity for paintball rupture which reduces the chance that a paintball game player will be taken out of competition due to a paintball feed jam.

5 Claims, 3 Drawing Sheets

LOW PROFILE PAINTBALL LOADER MOUNT

BACKGROUND OF THE INVENTION

1. Field of the Invention

This invention is generally related to the field of paintball guns. More particularly the invention relates to apparatuses for attaching paintball marker rapid loaders to the paintball gun.

2. Description of the Prior Art

The sport of paintball war games continues to grow in popularity. During these war games, participants shoot frangible plastic balls full of a liquid dye at their opponents. The games are sometimes intensely competitive, requiring a participant to aim a gun, known also as a marker, at an opponent while pursuing, fleeing, dodging, or running for cover. Participants are excluded from further play once they have been hit and marked by a paintball. Success in the game requires the capability to fire a large number of paintballs in a short amount of time. A participant might discharge between several hundred and one thousand or more paintballs during the typical game lasting only a few minutes. Success in the game also requires player agility, which include being able to move run, dive, and roll for cover while carrying the marker.

Numerous variations of loaders have been developed with the objective of rapidly feeding paintballs to the marker and are well-known in the art. The typical loader includes a large hopper to store a supply of paintballs, generally 200 to 300 balls. Early loaders located the hopper above the marker's breech and relied on gravity to move paintballs from the hopper to the breech. U.S. Pat. No. 5,161,516 by Lorenzetti discloses one such apparatus. Forced feeding became necessary as firing rates increased and gravity alone could not propel paintballs to the marker's breech at the increased firing rates. U.S. Pat. No. 5,794,606 by Deak and U.S. Pat. No. 6,502,567 by Christopher are representative examples of the conventional power-driven paintball loader.

Increased firing rates also spurred increases in hopper sizes to allow longer durations between reloads. Hoppers have remained typically located at the top of the marker, even as powered feed mechanisms became commonplace, to retain a short, direct path between the loader and the marker's breech. The result is that by optimizing the feed path, the location of many loaders in play today make the combination of the marker and loader more unwieldy to handle during the extreme maneuvers of competitive paintball games.

Still other loaders have emerged to address the problem of a high profile loader by relocating the hopper and feed mechanism to a less prominent location. U.S. Pat. No. 5,954,042 by Harvey and U.S. Pat. No. 6,488,019 by Kostiopoulos disclose loaders in which the paintball storage hopper and feed mechanism are mounted below the marker's barrel to reduce the overall profile of the marker and loader combination. U.S. Pat. No. 6,327,953 by Andresen discloses a loader that is worn by the player and feeds the paintball marker by a flexible feed supply conduit. U.S. Pat. No. 6,109,252 by Stevens discloses a high capacity loader that can be positioned in a variety of locations distant from the marker breech, including in a backpack. Such remote loader mounting options are not without drawback. As the loaders are located further from the marker's breech, the force needed to push paintballs through the longer and more convoluted feed tubes increases the incidence of ruptured paintballs in the feed mechanism which temporarily renders the paintball marker unusable and often results in the paintball player being "marked" by an opponent.

It is therefore desirable to have an improved paintball loader that features a reliable, high feed-rate mechanism capable of supplying paintballs to the breech of a paintball marker at a rate of at least the marker's firing rate while minimizing the potential to rupture a paintball during the feed process. It is also desirable to have an improved paintball loader attached to the paintball marker in a manner that minimizes the target presented to the player's opponents and is easily handled during the physical maneuvers common in paintball games.

SUMMARY OF THE INVENTION

The present invention improves upon known active paintball loaders by providing a mounting apparatus for a loader so that it may be attached to the compressed gas cylinder that powers the marker. Relocating the loader using the present invention reduces the target profile of the paintball game player by placing the loader and its storage container in a position where it can be tucked under the player's arm during the game. A conventional feed tube provides a conduit between the loader and the firing chamber of the paintball marker so that paintballs may be supplied to the marker. The location of the loader relative to the firing chamber allows use of a substantially straight feed tube which reduces the tendency for paintball rupture compared to feed tubes having a torturous feed path. Flexible internal guides located in the loader storage housing and used for directing paintballs into the feed tube are known in the art and are provided to further reduce the risks of loader jamming due to paintball rupture. Locating the loader on the compressed gas storage cylinder also reduces the frontal area of the marker/loader combination thereby reducing the target area of a competitor using the invention during a paintball competition.

DETAILED DESCRIPTION OF THE INVENTION

When referring to the Figures, like parts are numbered the same in all of the Figures.

Figure 1:
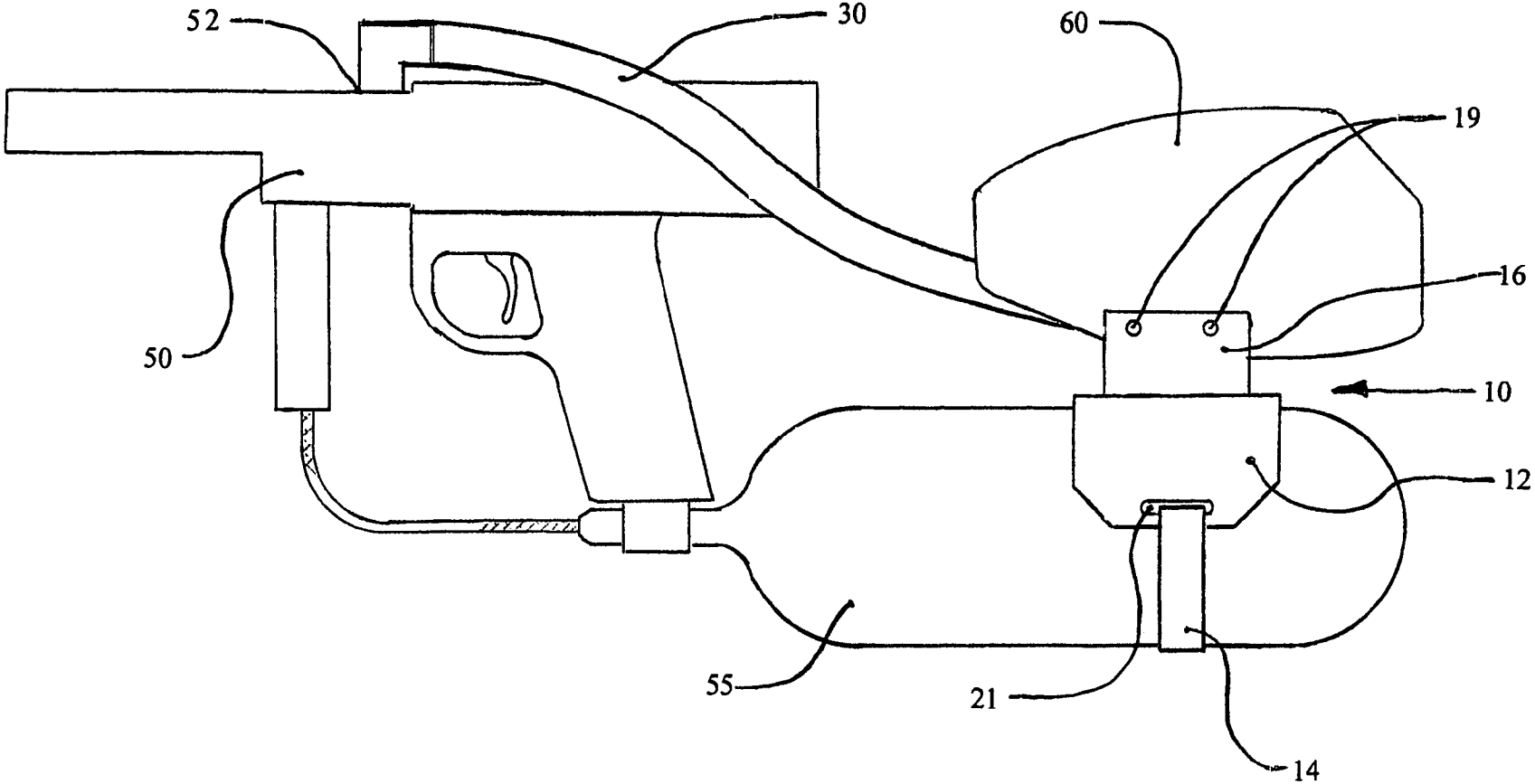
FIG. 1 shows a side view of the low profile paintball loader mount as it is used on a conventional compressed gas-powered paintball marker.

Referring to FIG. 1, the low profile loader mount 10 is shown in an operable position along with a conventional paintball marker 50, compressed gas cylinder 55, and powered rapid-loader 60. Loader mount 10 comprises saddle 12, retainer 14, and loader connector 16. Saddle 12 is curved to fit the outer circumference of compressed gas cylinder 55. Many competition-level paintball markers are powered by similar high capacity compressed gas cylinders to provide increased firing capacity without the need to replenish the compressed gas supply during the game. Typical high capacity cylinders have diameter of approximately four inches and attach to the marker in such a manner that the cylinder is located below and rearward relative to the paintball marker. By locating the loader the same area relative to the marker, the overall profile of the paintball marker, loader, and gas cylinder combination is compressed. Conventional loaders in which the loader storage container is located atop the marker present a target that extends above the player's head and body when the player is firing the marker thereby increasing the player's target profile. In the improved location, the loader storage container is located below and rearward from the conventional location and adjacent to the player's body when the player is firing the marker. The marker and loader therefore present no additional target area beyond that of the player's body thus providing a slight competitive advantage to the player over players using conventionally mounted loaders.

Continuing to refer to FIG. 1, saddle 12 is restrained adjacent to gas cylinder 55 when the low profile loader mount is configured for paintball game play. Retainer 14, a strap-like apparatus connected to saddle 12 by a pair of retainer slots 21, in combination with saddle 12 encircles the circumference of the gas cylinder and secures the invention to the gas cylinder. The length of retainer 14 is adjustable to enable the saddle to be securely attached to the gas cylinder thereby preventing relative movement during operation. Loader connector 16 is affixed to saddle 12 to provide means to connect a conventional paintball loader 60 to the low profile loader mount 10. Feed tube 30 extends from paintball loader 60 to the breech inlet 52 of paintball marker 50. The generally horizontal orientation and lack of extreme bends in the feed tube 30 reduces resistance to movement of paintballs within the feed tube thereby reducing the propensity of the loading mechanism to jam when a paintball ruptures within the feed apparatus. The outlet of loader 60 is also oriented in a generally horizontal direction to align with feed tube 30. The horizontal loader discharge design differs from typical loaders mounted atop the paintball marker which feed downward from the loader straight into the marker breech inlet.

Figure 2:
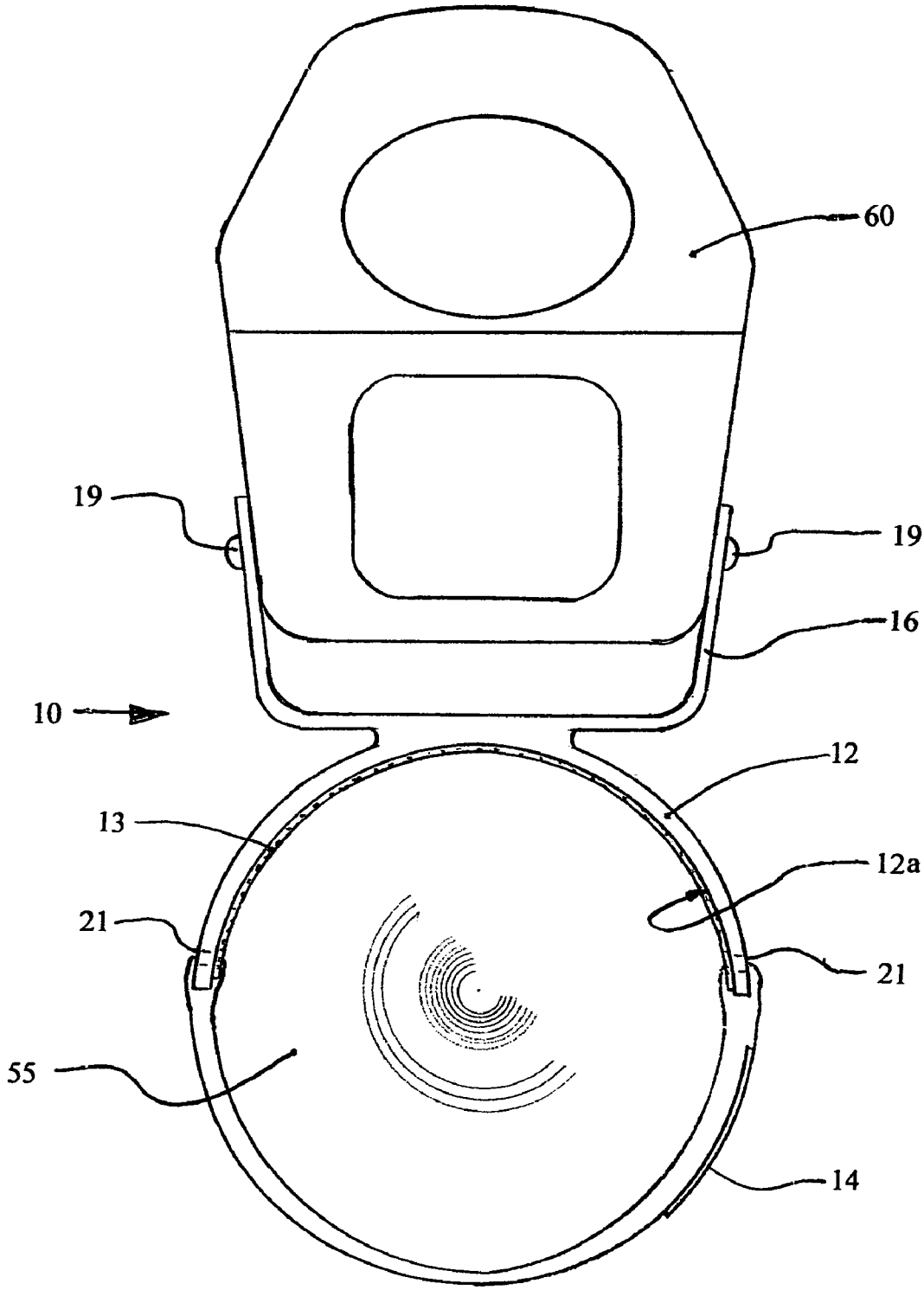
FIG. 2 shows a rear view of the low profile paintball loader mount.
Figure 3B:
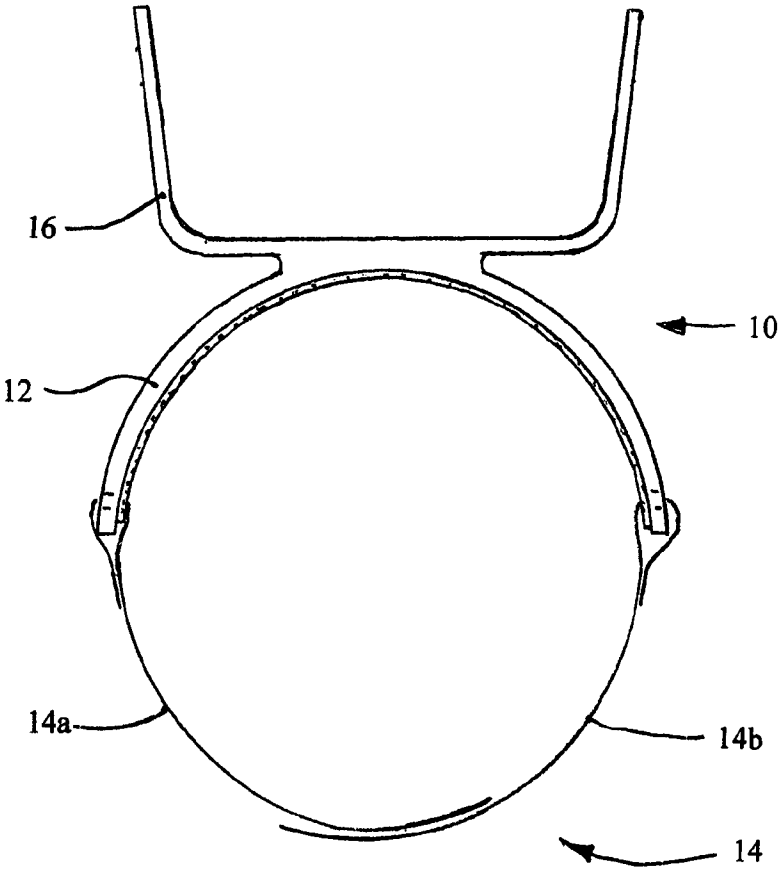
FIGS. 3*a* and 3*b* show alternate retainer details associated with the low profile paintball loader mount.
Figure 3A:
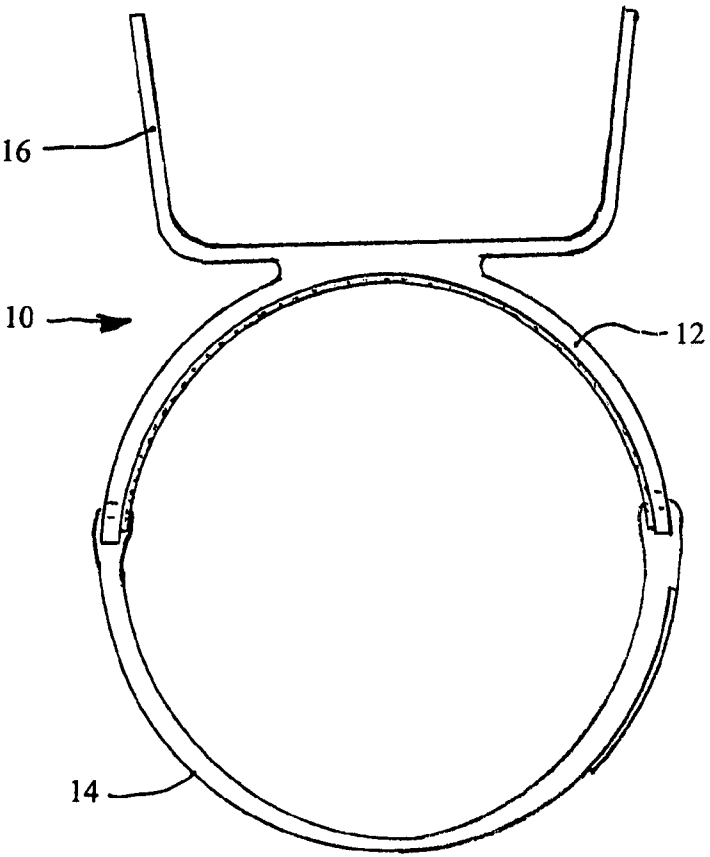

FIG. 2 provides a rear elevation view of the low profile loader mount showing saddle 12, loader mount 16 and retainer 14. Liner 13 is affixed to the inner circumference 12*a* of saddle 12. Liner 13 is made from rubber or similar non-abrasive rubberized material having a relatively high coefficient of friction. Retainer 14 is also shown in one possible embodiment. Other embodiments of retainer 14 are shown in FIGS. 3*a* and 3*b*. Continuing to refer to FIG. 2, retainer 14 is connected to saddle at retainer slots 21 in such a manner as to form a loop when combined with the inner circumference of saddle 12. The length of retainer 14 is adjustable so that the saddle and retainer combined can be secured around the gas cylinder 55. By tightening retainer 14, saddle 12 with liner 13 adjacent to the gas cylinder will remain in a fixed position in relation to the gas cylinder and provide a stable mounting apparatus for the paintball loader 60.

FIG. 2 also shows mount 16 as it is attached to loader 60. Mount 16 is attached to saddle 12. Loader 60 and saddle 12 are centrally located and symmetrically arranged over the centerline of the gas cylinder 55 and to maintain a balanced feel in the combined marker, gas cylinder, and loader apparatus and to eliminate the tendency of the loader to rotate about the gas cylinder due to unbalanced moment forces. In the preferred embodiment, the attachment is permanent, though removable connections using screws or similar fasteners may also be used to accomplish the same configuration. Loader 60 is attached to mount 16 using a plurality of fasteners 19 or other suitable means to connect the loader to the mount, such as interlocking fittings formed into the exterior of the loader and the mount. In an alternate embodiment, the low profile loader mount, including mount 16 and saddle 12 can be integrally formed with the housing for loader 60.

Referring to FIGS. 3*a* and 3*b*, shown are two alternate embodiments for retainer 14. In FIG. 3*a*, retainer 14 may be formed from a single strap that passes through both retainer slots 21 wherein the strap forms a circular loop in which the length of the strap, and therefore the circumference of the loop, is adjustable. When the retainer 14 is positioned around the gas cylinder 55, the loop will be flattened into a strap comprised of two layers of material as illustrated in FIG. 3. FIG. 3*b* shows a second embodiment, retainer 14 is comprised of a strap having first part 14*a* and a second part 14*b*, each part of the strap having two ends. One end of each part is secured to the retainer slots 21 on each side of the saddle. The other end of each part is attachable to the other so that the two parts can complete a single strap to encircle the gas cylinder. The attachment may be accomplished by using Velcro® on the free ends of the straps or by using a buckle.

A variety of materials made be used for form retainer 14. Velcro® strap provides the most versatility in that it allows the length of retainer 14 to be precisely adjusted to achieve a snug fit. Velcro® attachments are also easy to connect and disconnect. Straps of polymers, fabric webbing, leather, and metal are also envisioned, each with a suitable connection apparatus to enable the strap to length to be adjusted as described above.

Although the invention has been described in connection with specific examples and embodiments, those skilled in the art will recognize that the present invention is capable of other variations and modifications within the scope of the invention but beyond those described herein. These examples and embodiments are intended as typical of, rather than in any way limiting on, the scope of the present invention as presented in the following claims.

I claim as new and for which a Letters Patent of the United States is desired to be secured is:

1. In a loader for supplying paintballs to a gas-operated paintball gun having a barrel and a hollow firing chamber, the loader having a housing for storing a plurality of paintballs, the housing having an outlet opening, a feed tube having a first end connected to the outlet opening of the housing and a second end connectable to the firing chamber of the paintball gun when the loader is operatively mounted to the paintball gun, a paddle wheel rotatably disposed in the housing for feeding the paintballs into the feed tube, wherein the improvement comprises:

a mounting fixture attached to the loader housing and removably attachable to a compressed gas cylinder having an outer circumference and connected to the paintball gun, said mounting fixture further comprising a saddle, said saddle having an inner circumference shaped to fit adjacent to the outer circumference of the compressed gas cylinder, an inner circumference liner, a retainer connected to the saddle in a manner to encircle the compressed gas cylinder, and a connector attached to the saddle that is also attachable to the loader housing in a manner to prevent relative movement between the loader and the compressed gas cylinder.

2. The improvement as described in claim 1 wherein said retainer is a strap having a first end and a second end, said first and second ends connectable in a manner to allow the length of the strap to be adjusted.

3. A mounting fixture for securing a paintball loader to a compressed gas cylinder of a paintball marker comprising:

a paintball marker having a forward end, a generally opposing rearward end, and a firing axis along which a paintball is expelled from the marker extending therebetween, a firing chamber, said marker further having an inlet for receiving paintballs from the loader and conveying paintballs to the firing chamber;

a compressed gas cylinder for providing motive force for operating said marker connected to and extending from said marker;

a loader having a housing for storing a plurality of paintballs, a feed tube having a first end connected to said housing and a second end connectable to said marker inlet for conveying paintballs from said loader to said firing chamber;

a saddle having an inner circumferential surface configured to fit in adjacent contact with said compressed gas cylinder, said inner circumferential surface further having an area, said area being configured for frictional engagement with said compressed gas cylinder;

a connector attached to said saddle configured for connecting the loader to said saddle in a manner that minimizes the distance said loader projects above said firing axis; and a retainer connected to said saddle in a manner enabling said retainer to encircle said compressed gas cylinder and be selectively adjusted to alter frictional resistance between said inner circumferential surface and said cylinder so that relative movement between said mounting fixture and said gas cylinder is prevented.

4. The mounting fixture of claim 3, further comprising a lining connected to said inner circumference for increasing the friction between said mounting fixture and the gas cylinder.

5. The mounting fixture of claim 3, wherein said retainer is a strap having a first end and a second end, said first and second ends connectable in a manner to allow the length of the strap to be adjusted.

* * * * *